US006149134A

United States Patent [19]

Bank et al.

[11] Patent Number: 6,149,134

[45] Date of Patent: Nov. 21, 2000

[54] COMPOSITE MATERIAL HIGHWAY GUARDRAIL HAVING HIGH IMPACT ENERGY DISSIPATION CHARACTERISTICS

[75] Inventors: Lawrence Colin Bank, Madison, Wis.; Thomas Russell Gentry, Decatur, Ga.

[73] Assignee: Wisconsin Alumni Research Foundation, Madison, Wis.

[21] Appl. No.: 09/165,048

[22] Filed: Oct. 1, 1998

[51] Int. Cl.[7] ..... E01F 15/00; E01F 15/02

[52] U.S. Cl. ..... 256/13.1; 256/19; 404/6; 404/9

[58] Field of Search ..... 256/13.1, 1, 19; 404/6, 9, 10

[56] References Cited

U.S. PATENT DOCUMENTS

| | | | |
|---|---|---|---|
| 2,536,760 | 1/1951 | Martin et al. | 256/13.1 |
| 3,317,189 | 5/1967 | Rubenstein . | |
| 3,360,244 | 12/1967 | Bucher . | |
| 3,540,699 | 11/1970 | Guzzardella . | |
| 3,698,692 | 10/1972 | Burrows, Jr. et al. | 256/19 |
| 3,704,861 | 12/1972 | Glaesener | 256/1 X |
| 4,138,095 | 2/1979 | Humphrey . | |
| 4,231,676 | 11/1980 | Smith et al. | 404/6 |
| 4,307,973 | 12/1981 | Glaesener . | |
| 4,496,264 | 1/1985 | Casey | 404/6 |
| 4,498,660 | 2/1985 | Brema et al. | 256/19 |
| 4,681,302 | 7/1987 | Thompson . | |
| 4,684,107 | 8/1987 | Robbins, Jr. . | |
| 5,030,029 | 7/1991 | Johnsen . | |
| 5,054,954 | 10/1991 | Cobb et al. | 404/6 |
| 5,074,705 | 12/1991 | Schmitt | 404/6 |
| 5,161,783 | 11/1992 | German | 256/19 |
| 5,217,318 | 6/1993 | Peppel . | |
| 5,261,647 | 11/1993 | Venegas, Jr. et al. | 256/19 X |
| 5,425,594 | 6/1995 | Krage et al. | 404/6 |
| 5,429,449 | 7/1995 | Baatz | 404/6 |
| 5,622,356 | 4/1997 | Duggan | 256/1 |
| 5,660,496 | 8/1997 | Muller et al. | 404/6 |
| 5,779,389 | 6/1998 | Niemerski | 404/9 X |

FOREIGN PATENT DOCUMENTS

| | | | |
|---|---|---|---|
| 589605 A1 | 3/1994 | European Pat. Off. | 256/13.1 |
| 2134571 | 8/1984 | United Kingdom | 256/13.1 |

OTHER PUBLICATIONS

Gentry et al., Damage Evolution and Progressive Failure in Composite Material Highway Guardrails, AMD–Crashworthiness and Occupant Protection in Transportation Systems (ASME 1996) vol. 218, pp. 79–89.

McDevitt et al., New Materials for Roadside Safety Hardware, 1992 Materials Engineering Congress of the American Society of Civil Engineers Materials Division, Atlanta, Ga, (Aug. 10–12, 1992), pp. 1–14.

Palmer et al., Simulation of Progressive Failure of Pultruded Composite Beams in Three Point Bending Using LS–DYNA3D, 1997 International Composites Expo (Jan. 1997), Session 14–C, pp. 1–12.

*Primary Examiner*—Lynne H. Browne
*Assistant Examiner*—Danielle Somrak
*Attorney, Agent, or Firm*—Craig A. Fieschko, Esq.; DeWitt Ross &Stevens S.C.

[57] ABSTRACT

A guardrail system including a rail and rail connectors is described wherein the rail is formed of several elongated tubes which are integrally molded at the tube sidewalls. The tubes preferably have polygonal cross-sections with sidewalls situated in horizontal and vertical planes, with the vertical sidewalls of the various tubes staggered at different depths within the rail. Connections between rails may be achieved by internal connectors which fit within the tubes of adjacent rails, and/or by use of external connectors which receive the ends of adjacent rails. Such internal and external connectors may also be used to reinforce damaged rails to restore their performance characteristics.

20 Claims, 5 Drawing Sheets

COMPOSITE MATERIAL HIGHWAY GUARDRAIL HAVING HIGH IMPACT ENERGY DISSIPATION CHARACTERISTICS

GOVERNMENT LICENSE RIGHTS

This invention was made with United States government support awarded by the following agencies:

FHWA Grant No(s).: DTFH61-92-X-00012; DTFH61-95-X-00024

ONR Grant No(s).: N000167-96-C-0003

NSF Grant No(s).: CMS-9896074; CMS-9796327

The United States has certain rights in this invention.

FIELD OF THE INVENTION

This disclosure concerns an invention relating to highway guardrails, and more specifically to a non-rigid composite material highway guardrail for dissipating impact energy from vehicles.

BACKGROUND OF THE INVENTION

Guardrails are commonly provided about United States highways in areas where it is desirable to prevent vehicles from leaving the highway, e.g., at elevated portions of highway or between opposing lanes of traffic. Such guardrails can be generally classified into one of two performance categories, rigid and non-rigid. Rigid guardrails are not intended to deflect upon impact, and are instead intended to constrain the vehicle and redirect it onto the roadway. As an example, trapezoidal concrete slabs are commonly used to provide rigid guardrails between adjacent lanes of traffic. Non-rigid guardrails are intended to deflect upon impact so as to absorb and dissipate kinetic energy from an oncoming vehicle without overly damaging the vehicle and harming its passengers.

The most common non-rigid guardrail system is the w-beam guardrail, a hot-rolled steel rail having a w-shaped cross-section which is galvanized (zinc coated) for corrosion protection. W-beam guardrails are installed generally parallel to the highway on posts sunken into the ground, with the ends of adjacent rails being overlapped and bolted to the posts. A standard w-beam rail is sized, configured, and supported so as to allow up to approximately 1 meter of deflection when struck by a vehicle at highway speed. The w-beam primarily dissipates impact energy via several mechanisms: plastic flexural deformation of the rail; deformation and breakage of support posts; and the "plowing" of support posts through the ground. It is estimated that 600–800 million feet of w-beam guardrail is currently installed in the United States.

However, the w-beam guardrail suffers from several deficiencies. Its energy dissipation characteristics are such that substantial vehicle damage often occurs upon impact. Owing to recent trends toward increasing vehicle size, there is mounting concern that standard steel w-beams provide inadequate collision protection for today's traffic. The w-beam also has significant installation and replacement costs. Because of its weight and configuration, w-beam rails are difficult to transport, install, and remove by anything less than multi-person road crews, and they therefore tend to incur high labor costs. Costs can be further enhanced by the time and labor cost of closed traffic lanes and traffic rediversion during installation and replacement. It is notable that w-beam rails are generally not repaired after collisions because damage tends to be of such a permanent nature that repair is not cost-effective.

Despite these disadvantages, use of the w-beam guardrail is almost universal because appropriate alternatives are lacking, and it is otherwise viewed as providing an acceptable balance between its drawbacks and its benefits. As for its benefits, the w-beam guardrail has relatively low material cost in comparison to alternative guardrail systems, and it requires relatively low maintenance over its lifetime if it does not experience vehicle damage. If no collisions occur, the average operating lifetime of a w-beam rail is approximately 20 years, with lifetime mainly being determined by the corrosiveness of the beam's environment (e.g., whether the adjacent highway is salted in winter months). Nevertheless, since an estimated 3% of the existing w-beam guardrails require replacement each year, it is evident that installation and repair costs are significant.

As a result of the foregoing considerations, there is great interest in developing alternatives to the steel w-beam. Since plastics and composite materials have significantly different energy dissipation properties than metals, one area of interest to researchers is the possibility of developing plastic and composite guardrail systems. Examples of several such systems follow.

U.S. Pat. No. 3,317,189 to Rubenstein illustrates generally cylindrical and semicylindrical guardrails which are predominantly made of a rubber/concrete composite. These composite guardrails can also include a composite fiber-reinforced surface layer. Glass reinforcing cables may also extend through the length of the rail.

Several patents then propose plastic or composite guardrails which serve as hollow vessels for containing liquids or other energy-absorbing material. During impact, the vessels deflect and the filler material provides the majority of the energy dissipation. As examples, U.S. Pat. No. 4,681,302 to Thompson illustrates hollow plastic guardrail sections which may be joined end-to-end, and which may be filled with water to enhance energy dissipation. U.S. Pat. No. 3,540,699 to Guzzardella describes a guardrail having similar operation. U.S. Pat. No. 4,307,973 to Glaesener illustrates a guardrail having a sheet-metal shell filled with synthetic resin foam. U.S. Pat. No. 4,138,095 to Humphrey illustrates a guardrail having a hollow plastic base which may be filled with ballast and draped with baglike impact shields filled with sand or other granular material.

Other references then describe the testing and/or use of composite guardrails which are intended for mounting between supports along roadsides to function in the same manner as standard w-beam guardrails. The McDevitt and Dutta paper entitled "New Materials for Roadside Safety Hardware" (1992 Materials Engineering Congress of the American Society of Civil Engineers Materials Division, Atlanta, Ga., Aug. 10–12, 1992) notes the production of glass fiber-reinforced plastic w-beams. The March, 1995 issue of the journal *Plastics World* (at page 13) proposes the use of pultruded glass fiber-reinforced plastic tubes as highway guardrails. The 1996 ASME publication "Damage Evolution and Progressive Failure in Composite Material Highway Guardrails" by Gentry et al. describes a study of prototype guardrails formed of stock pultruded glass-fiber reinforced plastic bars and tubes which were bonded together to form beam-like guardrails.

Other proposed guardrail systems address the problem of inadequate energy dissipation in steel w-beams by utilizing plastic or composite support structures for the w-beams. U.S. Pat. No. 3,360,244 to Bucher illustrates the use of a series of plastic tubes mounted between a w-beam guardrail and its support posts. One or more tubes may be crushed when the w-beam is struck, and the crushed tube(s) may subsequently be replaced. U.S. Pat. No. 5,660,375 to Freeman describes a composite guardrail support post which is primarily designed to alleviate environmental concerns that arise where wooden support posts are used, but which is also stated to take safety concerns (i.e., impact behavior) into account.

However, none of the aforementioned plastic and/or composite guardrail systems are in widespread permanent use along U.S. highways. In general, they do not offer suitable energy dissipation characteristics at low enough cost that their substitution for steel w-beams is justifiable. Plastic and/or composite guardrails usually have higher material and production costs than steel w-beams, and they then require installation costs similar to those encountered with steel w-beams, making the composite guardrails overall significantly more expensive than w-beams. Installation is particularly expensive for the aforementioned vessel-type guardrails which require filling with energy-absorbing materials at the point of installation, since these are bulky and require time-consuming filling steps. The aforementioned composite beam-type guardrails also tend to incur high installation costs because they generally cannot be simply bolted to support posts in the same manner as steel w-beams. They have a greater tendency to fail at the bolts during impact, and therefore require specialized mounting structures and/or steps which significantly increase their costs.

SUMMARY OF THE INVENTION

The invention, which is defined by the claims set out at the end of this disclosure, is addressed to a guardrail which eliminates or relieves the foregoing disadvantages of prior guardrail systems, and which additionally offers advantages which are not provided by any known prior guardrails. A guardrail in accordance with the invention is formed of a plurality of elongated tubes which are integrally molded lengthwise to define an elongated rail. The tubes forming the rail preferably have generally polygonal cross-sections, each tube thereby including a series of generally planar tube sides joined at tube corners. Most preferably, the tubes have rectangular cross-sections and thus have a pair of opposing longer tube sides and a pair of opposing shorter tube sides joined at the tube corners. The tube sides are then preferably arranged so that all tube sides are oriented within orthogonal planes, i.e., with tube sides resting in generally horizontal planes (parallel to the ground) and vertical planes (perpendicular to the ground). As will be discussed in greater detail in the Detailed Description of the Invention section set out below, guardrails having these characteristics have been found to provide a unique mode of failure during collision which is highly effective in dissipating impact energy and which can be superior to that provided by standard w-beams. During impact, they experience (1) an initial elastic phase, wherein the rails bend elastically under the oncoming vehicle; (2) a tearing phase, wherein the tube sides tear from each other, thereby expending a significant amount of energy; and (3) a tension phase, wherein the horizontal tube sides twist to rest in generally vertical planes adjacent the vertical tube sides, and wherein these tube sides effectively form a collection of straps which restrain the oncoming vehicle.

Several additional features can further enhance the impact performance of the guardrail. First, the tubes are preferably arranged within the rail so that several tube sides combine to provide a nonplanar (stepped) front rail face, this front rail face most preferably having a concave configuration to better catch the face of an oncoming vehicle. As a result of the nonplanar rail face, several tube corners which are formed by the junction of only two tube sides are left exposed to protrude outwardly at the front rail face. This is believed to be advantageous because during impact, adjacent tube sides tear from each other and dissipate a great deal of impact energy. Tube corners which are formed of no more than two tube sides tear more easily than tube corners formed by multiple intersecting tube sides, and thus the tubes at the front rail face will dissipate a significant amount of impact energy. Further, owing to the nonplanar configuration of the front rail face, different tubes may be staggered at different depths so as to fail at different times as the vehicle advances. This can allow more gradual deceleration of the vehicle after it impacts the front rail face. In similar fashion, it can be advantageous to stagger the vertical sidewalls of the various tubes at various different depths behind the front rail face so as to enhance the spread of tube failures over time during collision. More generally, performance may be enhanced by staggering the various horizontal and vertical sidewalls of adjacent tubes in a variety of different planes across the rail's depth and height, a measure which may be achieved, for example, by varying the cross-sectional areas of adjacent tubes across the rail's depth and height.

Also, where the tubes have generally rectangular cross-sections, it is believed to be advantageous to situate the longer tube sides in generally horizontal planes and the shorter tube sides in generally vertical planes—in other words, to size the generally horizontally oriented tube sidewalls greater than the generally vertically oriented tube sidewalls so that most tubes have a depth greater than their height. This configuration offers a large number of tube corners at which tearing may occur to dissipate impact energy.

Apart from the aforementioned rail, guardrails in accordance with the invention may also include internal and/or external connectors which allow easy connection of adjacent rails, and which can additionally allow rapid repairs to be made to damaged rails. Exemplary internal connectors can be provided by elongated members which are shaped to complementarily fit within rail tubes, thereby allowing the internal connectors to extend within the tubes of adjacent rails to maintain them together. Alternatively, such internal connectors may be inserted within the tubes of damaged rails to reinforce them. The elongated members of the internal connectors preferably define tubes similar to those used in the rail so that the internal connector tubes have failure behavior similar to that of the rail tubes. This can allow impact energy to be more effectively transmitted along the internal connectors to be spread out and dissipated among adjacent rails. This further allows the internal connectors to substantially maintain the performance of a rail when inserted therein for repair purposes.

Exemplary external connectors may be provided by members having a channel shaped to complementarily receive at least a portion of a rail about its circumference. Rails may then be connected together in adjacent relation by inserting the ends of the rails in opposing ends of the external connector's channel. Such external connectors may also be used to repair a damaged rail by inserting the damaged portion of the rail within the channel so that the external connector covers the damaged rail portion. External connectors also preferably have an exterior surface which is shaped substantially complementary to that of their channels (and thus that of the rails) so that their behavior in impact approximates that of the rails within.

Apart from the energy dissipation advantages noted above, which are essentially safety advantages, it is noted that the inventive guardrails also offer cost advantages in comparison to common steel w-beam guardrails. As noted in the Background of the Invention section of this disclosure, steel w-beam guardrails must be replaced approximately once every 20 years (generally owing to rusting/corrosion), and they are expensive to replace owing to time, labor, and traffic control costs. The inventive guardrails are advantageous because (1) when the guardrails are formed of plastic or composite materials, they are highly resistant to corrosion and can have a longer standard operating lifetime than steel w-beams; (2) when formed of plastics/composites, the guardrails are significantly lighter than steel w-beams and can conceivably be carried and installed by a single person rather than a multi-person road crew; (3) installation is made significantly faster and easier by use of the aforementioned external and/or internal connectors, which are also installable by a single person; and (4) even where replacement appears to be necessitated by impact damage, it is often avoidable where the aforementioned external and/or internal connectors are used to effect repairs.

Further advantages, features, and objects of the invention will be apparent from the following Detailed Description of the Invention in conjunction with the associated drawings.

DETAILED DESCRIPTION OF PREFERRED EMBODIMENTS OF THE INVENTION

Figure 1:
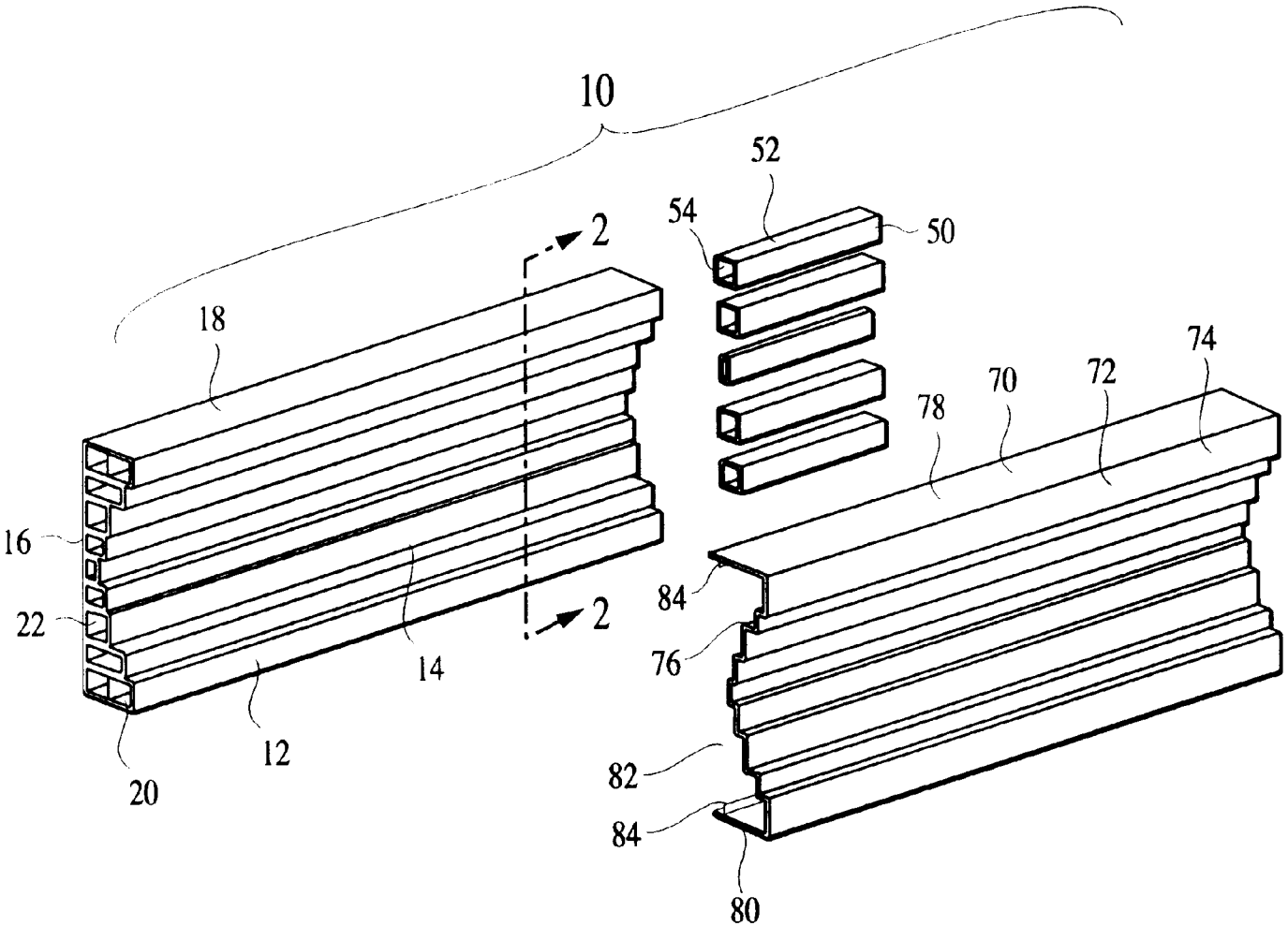
FIG. 1 is a front exploded perspective view of a preferred rail, shown with exemplary internal and external connectors.
Figure 2:
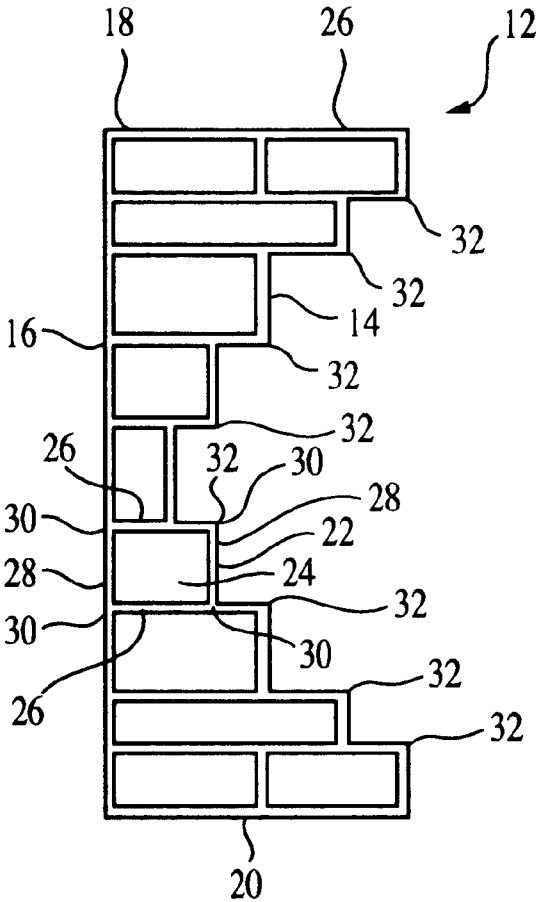
FIG. 2 is a sectional view of the rail of FIG. 1 shown from the line 2—2 in FIG. 1.

In the Drawings, wherein the same or similar features of the invention are designated in all Figures with the same reference numerals, a particularly preferred embodiment of the inventive guardrail is generally indicated in FIGS. 1 and 2 by the reference numeral 10. The primary component of the guardrail 10 is a rail 12, which may be joined to adjacent rails 12 (not shown) by use of the internal connectors 50 and/or external connectors 70 shown in FIG. 1. The rail 12, internal connectors 50, and external connectors 70 will now be discussed in turn.

With reference to FIGS. 1 and 2 and the orientation in which the rail 12 will be installed and used, the rail 12 can be considered to have a front rail side 14 which first receives an oncoming vehicle in the event of a collision, an opposing rear rail side 16 which will usually be affixed in abutment with a rail support (not shown), a top rail side 18, and an opposing bottom rail side 20. The rear rail side 16 is preferably planar to ease attachment to standard rail supports, whereas the front rail side 14 is preferably non-planar, for reasons that will be more fully discussed below. More specifically, the front rail side 14 is preferably concave over a major portion of its height, with greater depth near the top and bottom rail sides 18 and 20 and lesser depth at intermediate points.

With reference to FIG. 2, the rail 12 is formed of a plurality of integrally molded elongated tubes 22 having internal tube passages 24. The tubes 22 preferably have generally polygonal cross-sections; more specifically, in the case of rail 12, the cross-sections of the tubes 22 are rectangular. The tubes 22 also preferably have tube sidewalls which are generally orthogonally aligned with respect to the horizontal plane (i.e., to the plane of the ground), and thus can be considered to have generally horizontal tube sidewalls 26 and generally vertical tube sidewalls 28 which join at tube corners 30. Since the tubes 22 are integrally molded, adjacent tubes 22 share common tube sidewalls 26 or 28. The rail 12 is easily and most preferably formed of continuous glass fiber reinforced plastic material by use of pultrusion techniques, though other materials and modes of manufacture can be used instead. However, it is noted that the use of continuous fiber reinforcement is believed to offer significantly greater energy absorption characteristics than where reinforcement is provided by "chopped" or short fibers.

Prior to discussing further features of the guardrail 10, it will assist the reader's understanding to first describe the failure behavior of the rail 12 during impact. In testing, it is found that the force vs. deflection curve for the rail 12 follows three behavioral phases: an elastic phase, a tearing phase, and a tension phase. Descriptions of these phases follow.

During the elastic phase, the response of the rail 12 is elastic as it bends inwardly under the impact of a vehicle striking its front rail side 14. If the impact force is sufficiently low that the rail 12 remains in the elastic phase, the rail 12 will have a deflection which is generally linear in response to the impact force applied, and removal of the applied force will result in the rail 12 returning to its original shape with no (or minimal) permanent deformation.

The transition from the elastic phase to the tearing phase is marked by a sudden local failure (rupturing) immediately adjacent the points on the front rail side 14 where the loading is applied, rapid inward deflection of the rail 12 at these points, and a sudden release of elastic energy in the form of sound and material rupture of the tubes 22 at the loading points. This rupture, which is in the nature of a tearing action, has several unique features.

First, the rupturing occurs at the tube corners 30, at which adjacent tube sidewalls 26 and 28 are torn apart from one another. This is believed to occur because as the vehicle drives into the rail 12 and causes its length to bow inwardly, frontward generally vertical tube sidewalls 28 are placed in compression whereas rearward generally vertical tube sidewalls 28 are placed in tension, thereby causing high shear stress between the horizontal and vertical tube sidewalls 26 and 28. Tearing often occurs first at frontward tube corners 30, i.e., those nearer the front rail side 14 and the vehicle, and then in rearward tube corners 30 afterwards. Initial rupturing is probably promoted at the frontward tube corners 30 because the frontward edges of the horizontal tube sidewalls 26 can crush inwardly under the oncoming face of the vehicle, thereby weakening the frontward tube corners 30 and making them more susceptible to tearing.

Second, the generally horizontal tube sidewalls 26 usually tend to separate from the generally vertical tube sidewalls 28 in the plane of the inner surface of the generally vertical tube sidewalls 28. Thus, in most cases, the dimensions of the generally vertical tube sidewalls 28 are not reduced by tearing, whereas the dimensions of the generally horizontal tube sidewalls 26 are reduced by approximately the thickness of the generally vertical tube sidewalls 28.

During the tearing phase, as the loading advances deeper into the rail 12, the rupturing of the tube corners 30 progresses along the length of the rail 12 beginning at the area of impact and moving towards the ends of the rail 12. It is notable that the physical separation of the tube sidewalls 26 and 28 dissipates a great deal of impact energy, but at the same time this separation does not drastically reduce the load-bearing capacity of the rail 12 because the tube sidewalls 26 and 28 are still left largely intact to carry loads and slow the oncoming vehicle.

In the tension phase, the tube sides 26 and 28 experience primarily axial elongation. Initially, the generally horizontal tube sidewalls 26—which are being subjected to bending moments oriented about vertical axes—relieve stress by rolling/twisting along their lengths so that they begin to become oriented in a substantially vertical plane. As a result, both the generally horizontal tube sidewalls 26 and the generally vertical tube sidewalls 28 rest in substantially vertical planes as a collection of separate strap-like members extending between the anchor points of the rail 12. The sidewalls 26 and 28 thereby serve as a sort of web which extends across the vehicle's path, and which serves to further catch and slow the vehicle. As this occurs, the sidewalls 26 and 28 may elongate axially to some extent, but they rarely do so to the point where they fail in tension. Instead, the load is transferred to the structure anchoring the opposing sides of the rail, and further energy may be expended by these structures plowing through the ground. If this is still insufficient to stop the vehicle, the sidewalls 26 and 28 will generally fail by breaking at points at or adjacent the anchoring structure since stress concentrations are more likely to exist at these points.

This 3-stage failure behavior is regarded as being highly advantageous, and rails 12 having a configuration similar to that illustrated in FIGS. 1–2 with an overall height of approximately 38 cm from the top rail side 18 to the bottom rail side 20, an overall depth of approximately 12 cm from the front rail side 14 to the rear rail side 16, and with the concavity on the front rail side 14 having a measurement depth of approximately 65 cm, have been found to have superior energy dissipation characteristics (i.e., less severe vehicle deceleration) than standard steel w-beams. It is notable that when steel w-beams fail, they generally demonstrate only elastic and tension phases: they initially give elastically upon impact, and then deform plastically as the elastic limit is exceeded. A common problem illustrated by such guardrails is that if impact is not sufficient to exceed the elastic limit, the impacting vehicle can be sprung back into traffic to give rise to the possibility of chain reaction collisions. Plastic or composite rails 12 according to the present invention will generally not return a vehicle in this manner because they have a smaller elastic regime than the steel w-beam, and will enter the tearing and tension phases at a level of loading below the elastic limit of a steel w-beam.

Apart from those features of the rail 12 noted above, several other features of the rail 12 are believed to contribute to these superior energy dissipation characteristics. These features will now be reviewed.

Figure 3:
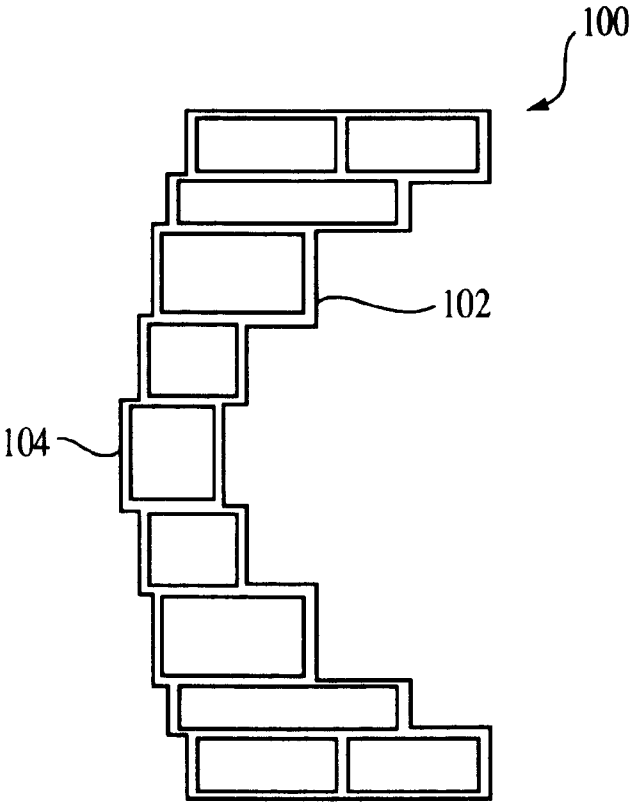
FIG. 3 is a sectional view of a second embodiment of a rail in accordance with the invention.
Figure 4:
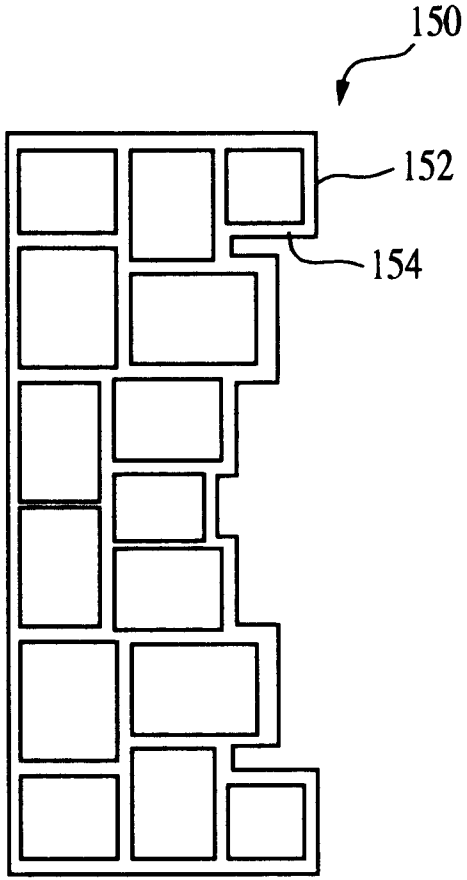
FIG. 4 is a sectional view of a third embodiment of a rail in accordance with the invention.

Initially, it is believed to be particularly beneficial to have the non-planar front rail side 14 be formed with tubes 22 having their generally vertical tube sidewalls 28 aligned along different planes. This is illustrated by the stepwise staggering of the frontward generally vertical tube sidewalls 28 within the front rail side 14 of the rail 12 of FIGS. 1–2, and is further exemplified by the rail 100 of FIG. 3, which includes respective front and rear rail sides 102 and 104 wherein all vertical tube sidewalls 106 are aligned within different vertical planes. The staggering of tube sidewalls 28 within different planes situates different tubes 22 so that their frontward sidewalls 28 encounter the advancing vehicle at different time. This is believed to promote failures in the tubes 22 which are spaced more evenly in time during vehicle impact, as opposed to simultaneous tube failures which occur periodically (e.g., substantially simultaneous failures of multiple tubes occurring at successive discrete time intervals). By designing the rail 12 to experience tube failures which are more evenly spaced in time during the impact period, the deceleration experienced by the colliding vehicle may be made less severe, and additionally may result in lesser overall damage to the rail 12. It is hypothesized that where several adjacent tubes 22 have vertical tube sidewalls 28 situated in the same plane, these sidewalls 28 may essentially form a common sidewall 28 for all of these tubes 22. As a result, these tubes 22 may be more prone to simultaneous failure than adjacent tubes 22 having vertical sidewalls 28 situated in different planes. The same principles are believed to generally hold for the generally horizontal sidewalls 26, and FIG. 4 illustrates a rail 150 having both vertical sidewalls 152 and horizontal sidewalls 154 staggered in a variety of horizontal and vertical planes by varying both the height and depth of the tubes across the height and depth of the entire rail 150.

It is also believed to be beneficial to form one or more sides of the rail 12 (particularly the front rail side 14) with one or more tube corners 30 which are formed by the intersection of no more than two tube sidewalls 26/28, as exemplified in FIG. 2 by the tube corners 30 which are also designated by the reference numeral 32. These tube corners 32 are "exposed" and can readily achieve tearing of their generally horizontal and generally vertical tube sidewalls 26 and 28 during the tearing phase. In contrast, the other tube corners 30 are effectively formed by the juncture of three or more sidewalls 26/28 (or segments thereof), and tearing may be more difficult to achieve at these corners. Since the tearing action dissipates a great deal of absorbed energy, it is desirable to avoid unduly hindering the tearing action.

Figure 5:
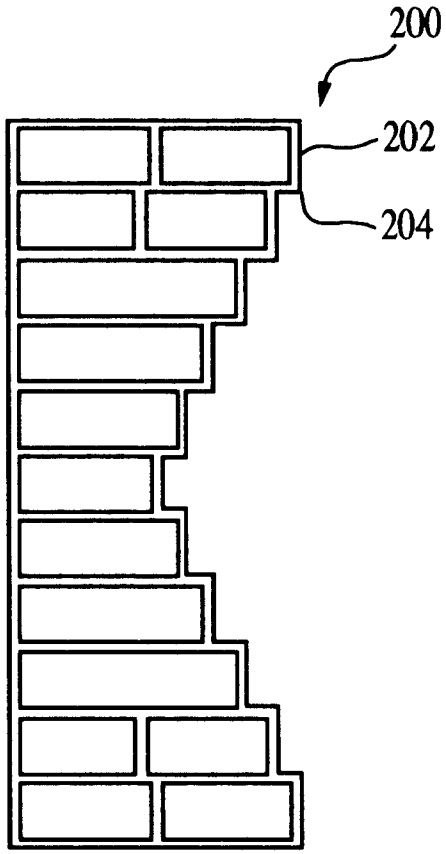
FIG. 5 is a sectional view of a fourth embodiment of a rail in accordance with the invention.

Additionally, it is believed that superior results may be obtained where a majority of the tubes 22 in the rail 12 have their generally horizontal tube sidewalls 26 sized greater than their generally vertical tube sidewalls 28 (i.e., wherein most of the tubes 22 have a depth greater than their height). If the tubes 22 are formed in this manner, the rail 12 will require a greater number of tubes 22 between its top and bottom sides 18 and 20 if the rail 12 is to have an acceptable overall height; as a result, a greater number of tube corners 30 are formed, thus increasing the overall amount of energy that the rail 12 can absorb in tearing. To illustrate, FIG. 5 illustrates a rail 200 wherein all tubes 202 have depths greater than their heights, and wherein more tubes 202 are provided over the height of the rail 200 than in the rail 12 of FIGS. 1–2, thereby providing more tube corners 204 at which tearing may occur. However, it is notable that too great of an increase in the depths of the generally horizontal tube sidewalls may hinder the ability of these sidewalls to begin twisting at the outset of the tension phase. Thus far, testing of prototype rails indicates that tubes having depth-to-height ratios of up to 2.5 operate well, and it is expected that good impact performance should be sustainable for higher ratios as well.

It has been found that where the tube sidewalls 26/28 are thicker, the tearing phase may be undesirably delayed and/or eliminated in some or all tubes 22. Thus, contrary to what one might expect when designing guardrails in accordance with prior practice, thicker tube sidewalls 26/28 can be undesirable. It is believed that beyond a certain ratio of cross-sectional tube dimensions to tube wall thicknesses, the tearing behavior would be completely lost, resulting in rapid catastrophic failure of the rail 12 rather than progressive failure. It is further believed that ratios of the tube passage 24 cross-sectional area to the tube sidewall 26/28 thickness should preferably be above 25, with ratios of 40–70 being particularly suitable. It is notable that when choosing wall thicknesses, the thickness of the generally horizontal tube sidewalls 26 is believed to be particularly critical because tearing occurs primarily along the generally horizontal tube sidewalls 26 during the tearing phase. Thus, the thickness of the generally horizontal tube sidewalls 26 should not be so great that tearing is deterred.

It is noted that the rails described above and illustrated in FIGS. 1–5 are merely preferred embodiments of the invention, and that rails in accordance with the invention may include modifications and additions to the aforementioned features. As examples, rails may include tubes having polygonal shapes other than rectangles (e.g., hexagons), or may include different cross-sectional shapes within the same rail (e.g., triangles and rectangles).

As noted above, the rail 12 is preferably formed of composite or plastic material. When the rail 12 is formed of glass fiber reinforced plastic to meet the dimensions set out above, the rail 12 is far lighter than a steel w-beam, and could conceivably be carried and installed by a single person. Taking into account installation and maintenance costs, the rail 12 should be less expensive over its operating lifetime than steel w-beams. Additionally, since the rail 12 can be made substantially weatherproof and corrosion-resistant with the choice of proper materials (e.g., by use of ultraviolet inhibitors, stabilizers, etc. within the plastic matrix), the operating lifetime of the rail 12 can be far longer than that of a steel w-beam. In addition, plastic and composite guardrails can advantageously be permanently brightly colored to draw attention to the limits of the roadway.

With plastic and composite guardrails, it is notable that it is also possible to manufacture guardrails having identical configurations but different properties by simply using the same manufacturing equipment and varying the raw materials used for the rail. For instance, different composite guardrail manufacturing runs can utilize different fibers and/or different fiber geometries between runs so that the rails 12 produced during the different runs have different properties. In some circumstances, this could allow additional cost savings; for instance, if composite rails 12 having higher energy dissipation characteristics are more expensive than rails 12 having lower energy dissipation characteristics, it may be cost-effective to produce runs of each and install each type of rail 12 in appropriate areas. As an example, high-energy rails 12 can be installed at the entry of highway ramps where high-speed impacts are more likely, and low-energy rails 12 can be installed further along the exit ramp. The ability to use colored fillers in plastic and composite guardrails to vary their colors could further allow rails 12 having different performance characteristics to be color-coded for identification and installation purposes.

Referring again to FIG. 1, the several internal connectors 50 are each sized and configured to complementarily fit within a respective internal tube passage 24 of the rail 12. The internal connectors 50 preferably have a tubelike or hollow form wherein a series of internal connector walls 52 surround a longitudinal passage 54. The tubelike configuration reduces the weight of the internal connectors 50, though solid or non-tubular shapes are also acceptable. The walls 52 are sized and configured to slide within their respective internal tube passages 24 with minor friction, preferably with friction sufficient to hinder the internal connectors 50 from sliding within the internal tube passages 24 without being pushed. As with the rail 12, the internal connectors 50 are preferably formed of pultruded glass fiber-reinforced plastic.

The primary purpose of the internal connectors 50 is to serve as a quickly and easily installed connector between adjoining rails 12. In this case, the internal connectors 50 may be partially inserted within one rail 12, may optionally be affixed to this rail 12 by use of fasteners, adhesives, or other attachment means, and another rail 12 may then be slipped over the protruding connectors 50 until the rails 12 are abutting (or otherwise have the desired degree of spacing). If desired, fasteners may be driven through the rails 12 and internal connectors 50 and into a support post 400 to firmly anchor adjacent rails together. Alternatively, fasteners could be used to affix the internal connectors 50 to support posts 400 and the rails 12 may then be freely supported between posts on the connectors 50.

Advantageously, where the internal connectors 50 are hollow, their behavior within the internal tube passages 24 during impact is substantially similar to that of the tubes 22. As a result, collision energy is very effectively transferred between adjacent rails 12 during collision, thereby better dissipating the energy. This property of the internal connectors 50 also makes them useful for purposes of repair: after a rail 12 experiences impact, internal connectors 50 can be inserted within the tubes 22 of the rail 12 (or at least those tubes 22 which have not fully entered the tension phase and experienced full separation of all generally horizonal and generally vertical tube sidewalls 26 and 28) to reinforce the rail 12 and restore a significant portion of its strength. In the case of a heavily damaged rail 12, internal connectors 50 are best used as only a temporary repair measure until replacement is convenient, but they may eliminate the need for replacement of lightly damaged rails 12.

FIG. 1 also illustrates a first embodiment of an external connector 70. The external connector 70, which is preferably also formed of pultruded glass fiber-reinforced plastic, includes a sheet 72 having front and rear faces 74 and 76 shaped substantially complementary to the front rail side 14. Therefore, the rear face 76 may be fit over the front rail side 14 in form-fitting fashion. In addition, top and bottom flanges 78 and 80 extend rearwardly from the rear face 76 at its lateral edges to fit in close abutment with the top and bottom rail sides 18 and 20 when the rear face 76 is fit over the front rail side 14. Altogether, the sheet 72 and top and bottom flanges 78 and 80 define a channel 82 which may receive the rail 12 therein. Inwardly-protruding lips 84 extend from the top and bottom flanges 78 and 80 in such a manner that the external connector 70 may be removably clipped onto the rail 12 to closely surround the top rail side 18, front side rail 14, and bottom rail side 20, with the lips 84 engaging the rear rail side 16. When the external connector 70 is formed of continuous glass fiber reinforced pultruded plastic, it is sufficiently flexible that it may be easily installed and removed on a rail 12 by flexing the top and bottom flanges 78 and 80 to fit around the top and bottom rail sides 18 and 20 until the lips 84 engage the rear rail side 16.

As with the internal connector 50, the external connector 70 may be used to connect two adjoining rails 12 or to reinforce a rail 12 which has suffered collision damage. In either case, the external connector 70 may be used either by itself or in combination with one or more internal connectors 50. Also similarly to the internal connector 50, the external connector 70 tends to perform similarly to the tubes 22 during collision, and it can help to effectively dissipate energy to adjoining rails 12 when used for connection purposes. When used for repair purposes, the external connector 70 serves to significantly reinforce the strength of a damaged rail 12 and restore its performance to a level closely approximating that of an undamaged rail 12.

Figure 6:
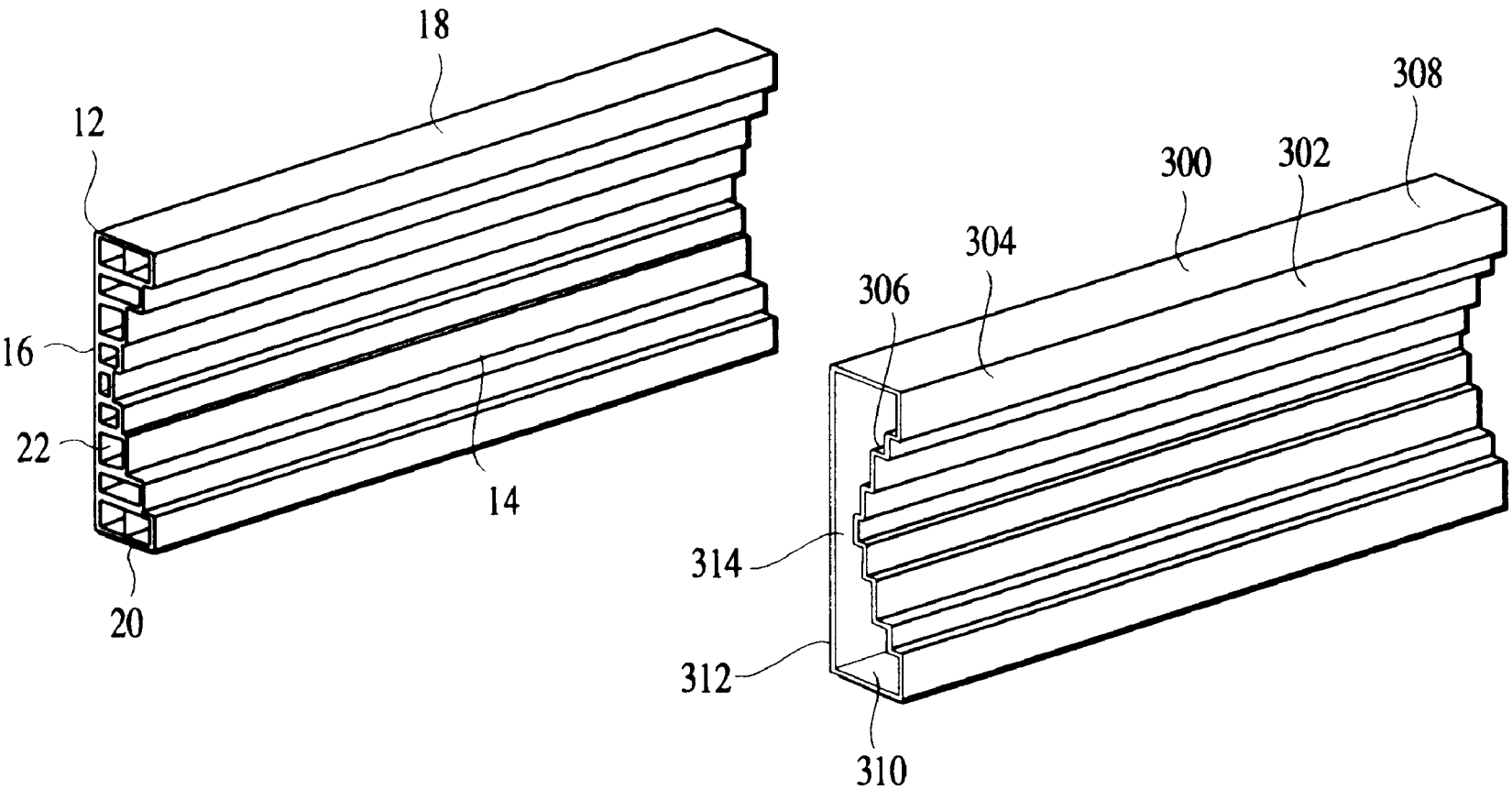
FIG. 6 is a front exploded perspective view of the rail of FIGS. 1 and 2, shown in conjunction with a second embodiment of an external connector.
Figure 7:
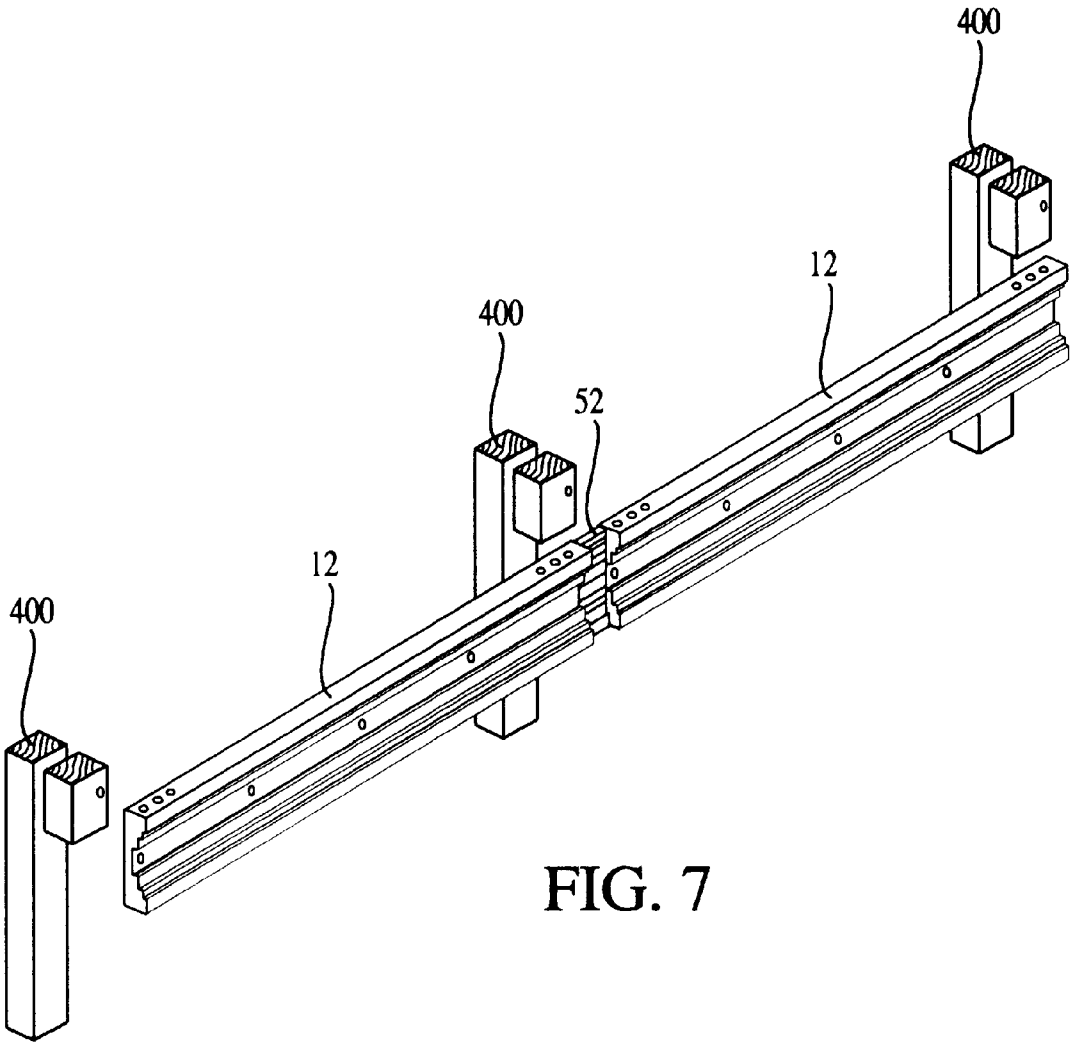
FIG. 7 is a front exploded perspective view of the rail of FIGS. 1 and 2, shown in conjunction with support posts.

FIG. 6 illustrates an alternative external connector 300. The external connector 300 includes a front sheet 302 having front and rear faces 304 and 306 which are shaped substantially complementary to the front rail side 14, and wherein the rear face 306 is sized and configured to fit in close abutment with the front rail side 14. The external connector 300 also includes a top sheet 308, a bottom sheet 310, and additionally a rear sheet 312, which combine with the front sheet 302 to define an enclosed channel 314 within the external connector 300. The rear face 306, similarly to the lips 84 of the external connector 70 of FIG. 2, serves to firmly retain the external connector 300 on one or more rails 12 with the rail(s) retained within the channel 314. However, because the external connector 300 fully surrounds the rail(s) 12, it serves to even more effectively transfer impact energies to adjoining rails 12, and/or bring a damaged rail closer to its original performance levels. The external connector 300 is preferred over the external connector 70 for purposes of affixing adjoining rails 12 together, particularly since its rear face 306 may be easily bolted onto a support post with rails 12 subsequently being inserted within its channel 314 to support the rails 12 on the support post. However, since the external connector 300 requires the insertion of rails 12 within its channel 314 for installation, the external connector 300 is not as well suited for retrofit repair of damaged rails 12 where these damaged rails do not have an exposed terminal end to allow such insertion.

The invention is not intended to be limited to the preferred embodiments described above, but rather is intended to be limited only by the claims set out below. Thus, the invention encompasses all alternate embodiments that fall literally or equivalently within the scope of these claims.

What is claimed is:

1. A guardrail comprising:

a plurality of elongated tubes having generally polygonal cross-sections, each tube thereby including a series of tube sides joined at tube corners, wherein the tubes are integrally molded lengthwise to define an elongated rail having rail sides ending in rail ends, and further wherein the rail sides include a nonplanar front rail side defined by several of the tube sides.

2. The guardrail of claim 1 wherein the front rail side is defined by a series of discrete tube sides separated by tube corners, and further wherein at least some of the discrete tube sides are situated in different planes.

3. The guardrail of claim 2 wherein at least some of the discrete tube sides are situated in different substantially parallel planes.

4. The guardrail of claim 3 wherein the front rail side includes upper and lower edges which define a front plane, with the rail having a depth defined rearwardly of this front plane and a height defined between the upper and lower edges, and wherein at least some of the tubes include tube sides which are generally parallel to the front plane and also tube sides which are generally perpendicular to the front plane, and wherein the tube sides which are generally parallel to the front plane are situated at different depths across the height of the rail.

5. The guardrail of claim 1 wherein the nonplanar rail side includes tube corners protruding outwardly therefrom.

6. The guardrail of claim 5 wherein at least one of the outwardly-protruding tube corners is defined by the juncture of no more than two of the tube sides.

7. The guardrail of claim 5 wherein the front rail side includes upper and lower edges between which the height of the rail is defined, and a depth measured rearwardly of a front plane intersecting the upper and lower edges, and wherein the rail includes tube sides situated generally parallel to the front plane, and further wherein these tube sides are situated at different depths across the height of the rail.

8. The guardrail of claim 1 wherein at least a majority of the tube sides are situated in orthogonal planes.

9. The guardrail of claim 1 wherein the front rail side is defined by the sidewalls of several of the tubes, and wherein these tubes have at least two different cross-sectional areas.

10. The guardrail of claim 1 wherein the front rail side includes upper and lower edges which define a front plane, with the rail having a depth defined rearwardly of this front plane and a height defined between the upper and lower edges, and wherein at least some of the tubes include tube sides which are generally parallel to the front plane and also tube sides which are generally perpendicular to the front plane, and wherein the tube sides which are generally parallel to the front plane are situated at different depths across the height of the rail.

11. The guardrail of claim 1 wherein the front rail side includes upper and lower edges which define a front plane, with the rail having a depth defined rearwardly of this front plane and a height defined between the upper and lower edges, wherein at least some of the tubes include tube sides which are generally parallel to the front plane and also tube sides which are generally perpendicular to the front plane, and wherein a majority of the tube sides which are generally perpendicular to the front plane have depths greater than the heights of the tube sides which are generally perpendicular to the front plane.

12. The guardrail of claim 1 wherein at least a majority of the tubes have generally rectangular cross-sections, each tube thereby including a pair of opposing longer tube sides and a pair of opposing shorter tube sides, and wherein the longer tube sides are oriented in generally parallel planes.

13. The guardrail of claim 1 in combination with supports affixed to a roadside surface, wherein the rail extends between at least two supports in a direction generally parallel to the roadside surface.

14. The guardrail of claim 1 in combination with a second guardrail and a guardrail external connector, the guardrail external connector including an internal surface which defines a channel and an external surface, wherein the rails are situated in end-to-end abutment, and wherein the channel is shaped to receive the abutting ends of the rails therein with the internal surface fitting about at least some of the rail sides in substantially complementary fashion.

15. The guardrail of claim 14 wherein the internal surface of the guardrail external connector fits about all of the rail sides.

16. The guardrail of claim 14 wherein the external surface of the guardrail external connector is shaped complementary to the rail sides about which the internal surface fits.

17. The guardrail of claim 1 in combination with a guardrail internal connector, the guardrail internal connector comprising an elongated member shaped to complementarily fit into one tube of the rail.

18. The guardrail of claim 17 wherein the elongated member is a tube.

19. A guardrail comprising:

a plurality of elongated tubes having generally rectangular cross-sections, each tube thereby including a pair of opposing longer tube sides and a pair of opposing shorter tube sides joined at tube corners, wherein the tubes are integrally molded lengthwise to define an elongated rail having rail sides ending in rail ends, and further wherein at least a majority of the longer tube sides are oriented in generally parallel planes.

20. A guardrail comprising:

a plurality of elongated tubes, each tube including a series of tube sides joined at tube corners, wherein the tubes are integrally molded lengthwise to define an elongated rail having opposing rail ends with rail sides extending therebetween, the rail sides including a concave rail side defined by several adjoining tube sides, each such tube side being oriented generally perpendicularly to the tube sides which it adjoins.

* * * * *